US010184089B2

(12) United States Patent
Cross, Jr. et al.

(10) Patent No.: US 10,184,089 B2
(45) Date of Patent: Jan. 22, 2019

(54) PROCESS FOR THE AROMATIZATION OF DILUTE ETHYLENE

(71) Applicant: INVISTA North America S.á.r.l, Wilmington, DE (US)

(72) Inventors: William M. Cross, Jr., Wichita, KS (US); Daniel Travis Shay, Media, PA (US); Rui Chi Zhang, Beijing (CN); Fang Zhang, Beijing (CN)

(73) Assignee: INVISTA NORTH AMERICA S.A.R.L., Wilmington, DE (US)

( * ) Notice: Subject to any disclaimer, the term of this patent is extended or adjusted under 35 U.S.C. 154(b) by 39 days.

(21) Appl. No.: 14/825,815

(22) Filed: Aug. 13, 2015

(65) Prior Publication Data

US 2017/0044446 A1 Feb. 16, 2017

(51) Int. Cl.

*C10G 57/00* (2006.01)
*C10G 50/00* (2006.01)
*C10G 70/00* (2006.01)

(52) U.S. Cl.

CPC ..... *C10G 57/00* (2013.01); *C10G 50/00* (2013.01); *C10G 70/00* (2013.01); *C10G 2300/1092* (2013.01)

(58) Field of Classification Search

CPC ..... C10G 57/00; C10G 50/00
See application file for complete search history.

(56) References Cited

U.S. PATENT DOCUMENTS 3,060,978 A 6/1976 Givens et al.
4,590,322 A * 5/1986 Chu ..... C07C 2/00 585/407
4,795,844 A 1/1989 Martindale et al.
4,849,568 A * 7/1989 McCullen ..... B01J 29/40 585/415
4,899,006 A 2/1990 Dave et al.
7,419,930 B2 9/2008 Carati et al.
7,498,473 B2 3/2009 Zhou et al.
7,786,337 B2 8/2010 Brown et al.
8,716,542 B2 5/2014 Brown et al.
2006/0194999 A1* 8/2006 Brown ..... C10G 50/00 585/467
2009/0030253 A1* 1/2009 Xu ..... C07C 2/76 585/417
2010/0247391 A1 9/2010 Nicholas et al.
2010/0249474 A1 9/2010 Nicholas et al.
2010/0249480 A1 9/2010 Nicholas et al.
2011/0073527 A1* 3/2011 Jan ..... C10G 25/05 208/254 R
2014/0024870 A1 1/2014 Nicholas et al.

OTHER PUBLICATIONS

Chen et al., "M-Forming Process", Ind. Eng. Chem. Res., vol. 26, No. 4, 1987, pp. 706-711.
Choudhary et al., "Aromatization of Dilute Ethylene Over Ga-Modified ZSM-5 Type Zeolite Catalysts", Microporous and Mesoporous Materials, vol. 47, Issues 2-3, Oct. 2001, pp. 253-267.

* cited by examiner

*Primary Examiner* — Brian A McCaig
*Assistant Examiner* — Jason Y Chong
(74) *Attorney, Agent, or Firm* — Licata & Tyrrell P.C.; William J. Simmons

(57) ABSTRACT

Described herein are processes for the conversion of ethylene into C5+ olefins, naphthenics, and aromatics via a dual catalyst reaction utilizing a dehydroaromatization catalyst.

20 Claims, 3 Drawing Sheets

PROCESS FOR THE AROMATIZATION OF DILUTE ETHYLENE

TECHNICAL FIELD

The present disclosure relates to processes for the conversion of ethylene into C5+ olefins, naphthenics, and aromatics. The processes utilize a dehydroaromatization catalyst for the conversion of dilute ethylene and other olefins, such as propylene and butenes, into a polygas material containing aromatics. The resulting polygas product produced is of high octane and may be directly used as a gasoline blendstock or as feed to an extraction process for aromatics production, for example.

SUMMARY

Fluidized catalytic cracking (FCC) has wide applications within refineries for the conversion of heavy gas oils into lighter hydrocarbon. The operations intent is to produce material, which falls within the gasoline and diesel boiling range. A substantial quantity of light end materials, particularly those of C3 and C4 olefins, are produced in the FCC operation. Those light materials are often converted into gasoline boiling range products, using either an alkylation unit or a polygas operation.

Both of those process operations offer operational robustness to handle FCC produced feeds. The main challenge is developing a process solution which can readily handle contaminants produced in the FCC, such as organic sulphur and organic nitrogen, using heavy feeds, such as vacuum gas oil. For alkylation or polygas operations, this challenge is typically met by using relatively inexpensive catalysis.

An even lighter cut of FCC material, FCC off-gas, also presents challenges with potential contaminants present, which can affect heterogeneous catalysts and their use. For instance, FCC off-gas streams contain valuable ethylene and propylene in relatively small quantities, for example, in quantities less than 20%. FCC off-gas may also contain heterogeneous catalyst poisons, such as hydrogen sulfide, carbon monoxide, carbon dioxide, organic nitrogen, and water.

To address those challenges, a common and simple solution is to burn the FCC off-gas in a refinery furnace to produce useful plant heat. Other solutions include it's use as co-feed into a stream cracker for petrochemical production or collection of its constituent compounds using more elaborate vapour recovery systems, involving compression, adsorption, and subsequent distillation steps. However, both cracker and vapour recovery options are typically expensive and normally only economically justified, when the FCC unit is either quite large or the refinery FCC is nearby other plants or streams which may be combined, pooled, and more economically recovered. As such, for the smaller refiners, there is a need within the industry for a less expensive option, which offers higher value use for FCC off-gas, verses that of combustion and associated heating.

U.S. Pat. No. 3,960,978 discloses metalized (cation exchanged) zeolytes, such as ZSM-5 & ZSM-11, that comprise metals such as Zn, Cr, Pt, Pd, Ni, and Re, for example, the process technology M-Forming™ (Chen et al., 1986). The general understanding is that the ion exchange adds oligomerization capability to the aromatization functionality within the zeolite matrix that may enable the conversion of low molecular weight olefins, such as propylene, into oligomers and aromatics, via the catalyst's dehydrocyclization functionality. Unfortunately, the U.S. refining industry has lacked wide adoption of this particular technology, either due to economic and/or technical reasons.

U.S. Pat. No. 4,795,844 illustrates a process for the conversion of C3 and C4 olefin containing streams containing at least 50% paraffins using a solid catalyst containing Gallium. U.S. Pat. No. 7,419,930 shows the utility of MFI & MEL type zeolytes containing Gallium for such conversions. U.S. Pat. No. 7,786,337 provides background on the use of a dual catalyst systems containing both zeolite and solid phosphoric acid catalysts for the production of heavier molecules. U.S. Pat. No. 7,498,473 proposes the use of control water for such systems, and U.S. Pat. No. 8,716,542 illustrates the use of a dual zeolite catalyst system for handling feed streams containing sulphur species.

Other processes allow for the conversion of dilute ethylene into useful fuels and aromatics. For instance, U.S. Pat. No. 4,899,006 provides background in the field of lighter olefin conversion, using operating temperatures between 580° C. and 750° C., over a catalyst also comprising zeolite with Gallium. Similarly, in 2001, Choudhary published results on the aromatization of ethylene to aromatics over Gallium modified ZSM-5. (Choudhary et al., 2001).

Catalyst applications substantially involving crystalline zeolites are also known. For example, U.S. Patent Application Publication Nos. 2010/0247391, 2010/0249474, 2010/0249480, and 2014/0024870, describe processes using amorphous silica alumina materials, containing Group VIII & Group VIB metals for C5+ oligomer production. One challenge has been to find an economic solution, applicable for single site facilities, which can provide for both high conversions of both ethylene and propylene into condensable, liquid materials. This requires both a simple process & robust catalyst solution, which can readily handle impurities common in FCC off-gas feeds.

Accordingly, the present disclosure relates to economic processes of converting FCC off-gas feedstocks into naphtha boiling range components utilizing a robust catalyst under relatively low pressure conditions for small, single refinery sites. The presently disclosed processes allow for the (1) substantial removal of basic nitrogen components from the feedstock to protect the catalyst, (2) use of a robust catalyst which can handle small quantities of sulphur, and (3) economical choice of a fixed bed reactor design containing at least two beds of catalyst.

DETAILED DESCRIPTION

Before the present embodiments are described, it is to be understood that the present disclosure is not limited to the particular processes, catalysts and systems described, as these may vary. It is also to be understood that the terminology used in the description is for the purpose of describing the particular versions or embodiments only, and is not intended to limit the scope of the present disclosure.

In general, this document provides, according to certain embodiments, for processes for converting ethylene into C5+ olefins, naphthenics, and aromatics. The processes utilize a dehydroaromatization catalyst for the conversion of dilute ethylene and other olefins, such as propylene and butenes, into a polygas material containing aromatics. The resulting polygas product produced is of high octane and may be directly used as a gasoline blendstock or as feed to an extraction process for aromatics production.

In at least one embodiment, the catalyst reactors may be taken off-line from the processing of the FCC-off gas and regenerated periodically using air and nitrogen. One catalyst reactor may be operating while the other reactor is regenerated.

In accordance with the presently disclosed process, the catalyst contains the zeolyte ZSM-5 at concentrations between 20-85% weight, Zinc or Copper at concentrations less than 3% weight, and one element of Group IA or IIA at concentrations less than 3% weight, along with an amorphous binder comprising silica and or alumina. The catalyst may provide a high conversion of ethylene in the off-gas at conditions between 200-400° C., at operational pressures below 400 psig.

Figure 1:
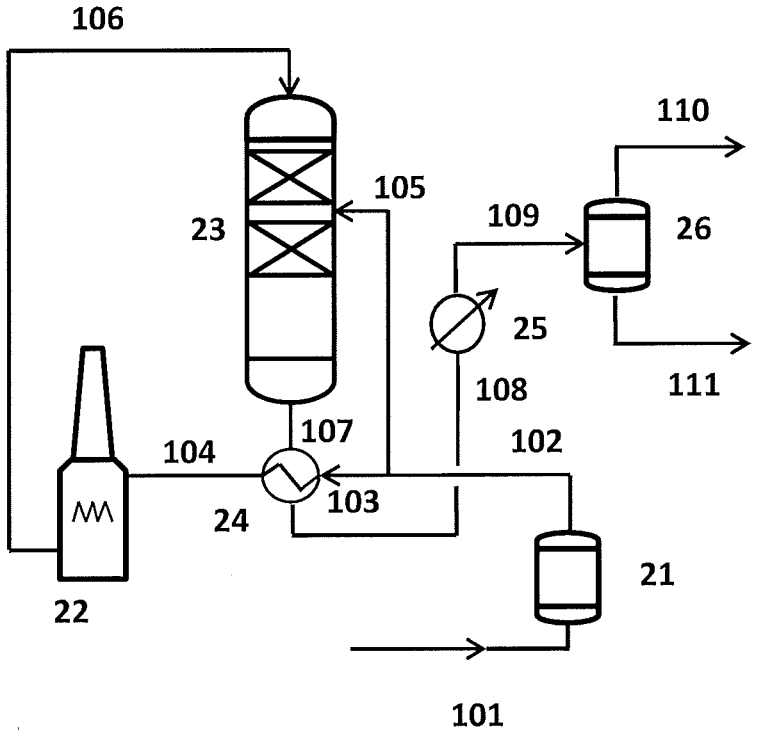
FIG. 1 is a schematic of an exemplary process for the conversion of methane, ethane, and ethylene using a multibed downflow reactor.
Figure 2:
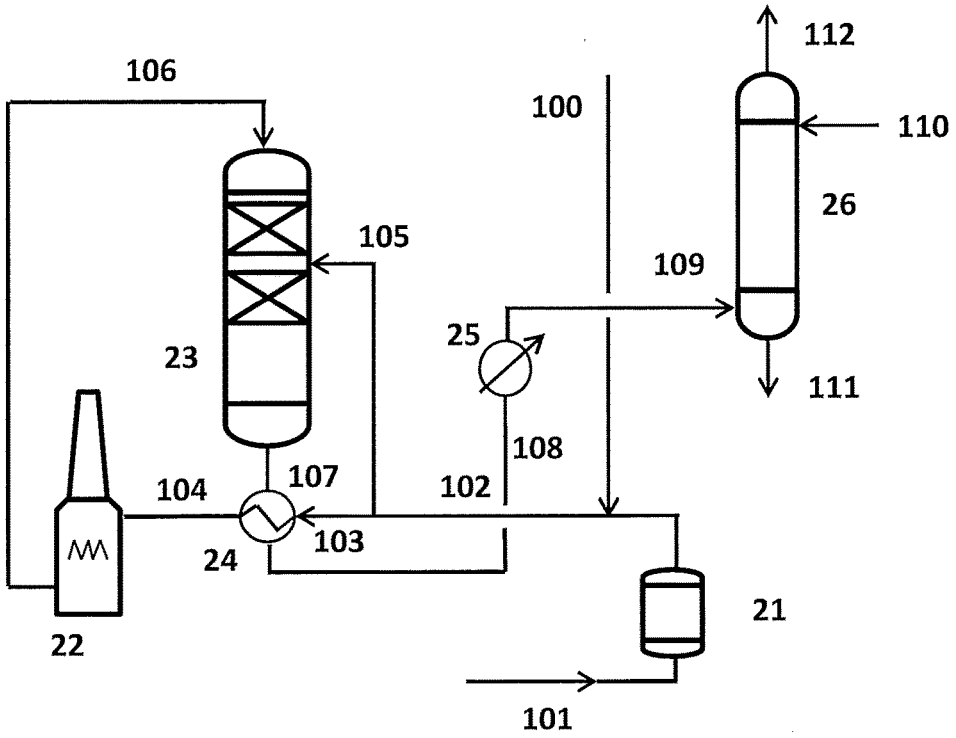
FIG. 2 is a schematic of an exemplary process for the conversion of ethylene in high concentration within a methane and ethane containing feed using a multibed downflow reactor and a diluent

FIG. 1 depicts a process diagram for the conversion of dilute ethylene and other light materials (such as methane and ethane) and heavier olefins (such as propylene and butylene) into larger olefinic, naphthenic, and aromatic components, and removes them from the gas stream. Dilute gas feed containing methane, ethane, and ethylene enters the process as Stream 101 at relatively low temperature (120° F.) and pressure (150 psig). The gas feed contains trace nitrogen compounds (ppm levels), which may include ammonia, amines, and/or nitriles. These nitrogen components are removed using a vessel containing solid adsorbent (21). The remaining stream 102 is substantially free of basic nitrogen and is further split into two streams 103 & 105. Stream 103 is sent through exchangers and heaters prior to reaction. Cross-exchanger 24, uses the hot reactor effluent to heat the cold inlet feed gas, stream 103. Typical temperatures of approximately 300 to 600° F. are achieved using the cross-exchanger, resulting in stream 104. Stream 104 is further heated to a reaction temperature of approximately 500 to 700° F. using fired heater 22. Hot gas feed, 106, enters the top of reactor 23. It flows downward and is at least partially reacted over a $1^{st}$ catalyst bed containing a zeolite catalyst. As the material reacts, it increases in temperature. Cooler feed 105 is then injected into the reactor, reducing the temperature prior to being introduced into the second catalyst bed. The combined effluent, from the $1^{st}$ catalyst bed and injection 105, are then further reacted over a $2^{nd}$ catalyst bed. Hot reactor effluent, 107, exits the reactor and is cooled using cross-exchanger 24 and cooler 25. The resulting product stream 109, containing 2-phase liquid and vapour products are separated in vessel 26. The majority of methane and ethane, which enter with the feed, exit the process in Stream 110, and a substantial portion of naphtha boiling range material exits as Stream 111. FIG. 2 represents a further elaboration of the invention as related to conversion of dilute ethylene. For maintaining the desired temperatures, within the illustrated multibed reactor, FIG. 1 describes the use of cold feed injection. Here, FIG. 2 describes the use of a diluent, in the instance where ethylene is present with a feed at a relatively high concentration. In this case, 20% by weight of ethylene or higher, within a reactor feed stream, would be considered high and a potential diluent solution would be of interest.

For most applications, considered herein, the unreacted material, depicted as Stream 110 in FIG. 1, is utilized as Fuel gas within a refinery complex. Often natural gas or methane is used to supplement this Fuel gas supply need. In such an instance, rather than downstream blending of natural gas or methane for supply, the process itself be better leveraged using this feed, should the feed ethylene concentration be considered high.

In FIG. 2, Stream 101 contains the rich ethylene gas in high concentration, within a methane and ethane containing feed. That stream is further diluted using Natural gas make-up via Stream 100. The diluted feed then processed similarly to that, as described by FIG. 1. A primary benefit to such a diluent approach, using of methane or Natural Gas, is that the design readily allows for mitigation of unit upset conditions. For this overall process, the reactions are quite exothermic. High heat recovery via cross exchange in a case with relatively high ethylene concentrations can lead to sudden high temperatures within a reactor. To mitigate such temperature excursions, methane or Natural Gas dilution offers a preferred means to the invention. Optionally, the methane or Natural Gas injection can contain water at its saturation level.

In addition to the use of Natural gas for control of the feed composition, an absorber (26) is depicted in FIG. 2. As the feed stream to this system is now more dilute, separation of vapour and liquid can become more difficult, at the operating pressures of interest.

In such a case, it is of benefit to use a heavy absorbent fluid, such as a distillate (or diesel) range material, to achieve high recovery of the heavier naphtha boiling range components within the cooled effluent gas stream 109. Stream 110 represents the heavy absorbent which is sent counter-current to that to the absorber gas feed, 109. Inside the absorber, 26, are sections of packing or trays to allow for efficient gas liquid contact and allow for high recovery of the C5+ materials from the gas stream.

Vapor recovered overhead of the absorber contains the methane present in the feed as well as that of the injection. As mentioned, the vapor product may be used within a plants fuel gas header.

From FIG. 2, absorber bottoms (111) is then sent for stabilization for removal of light ends (such as C2's & C3's) and recovery of the naphtha material (C5-C12) from the heavy absorbent. A portion of the heavy absorbent can be recycled once a significant fraction of the naphtha cut is removed.

Figure 3:
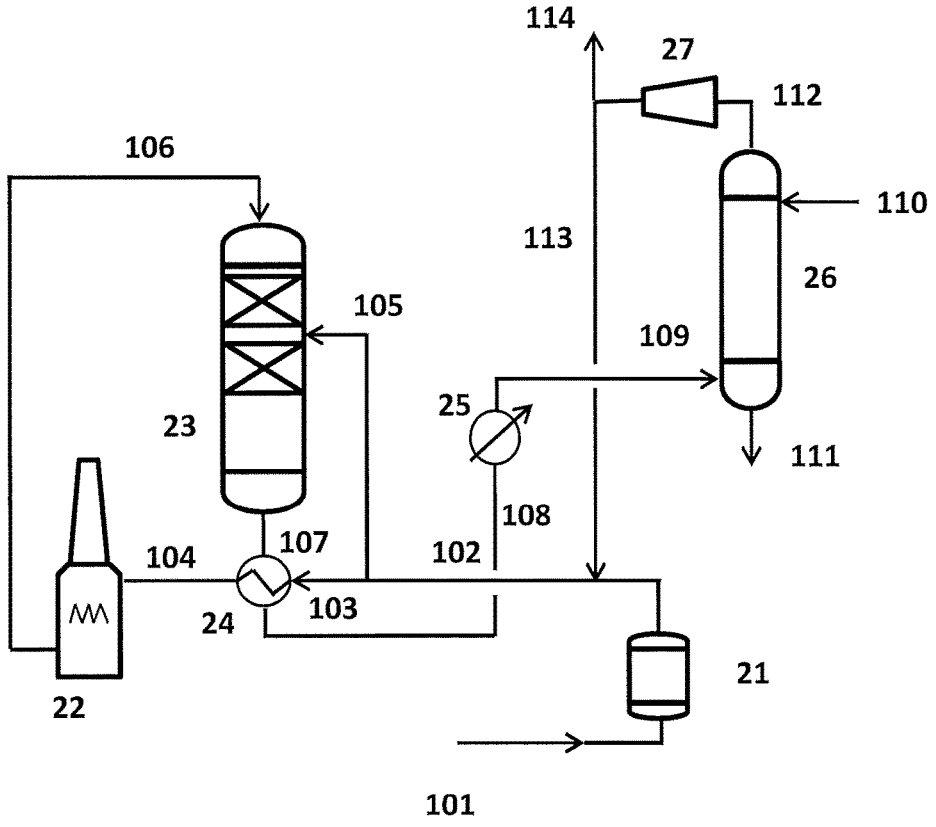
FIG. 3 is a schematic of an exemplary process for the conversion of ethylene in high concentration within a methane and ethane containing feed using a multibed downflow reactor and recycle compression

For the case where a diluent, such as Natural gas, is not available or feasible, a process, as depicted in FIG. 3, may be used. As illustrated, vapour, 112, recovered from the absorber, which is substantially depleted of ethylene is utilized as the diluent for the feed to the process. Vapor 112 is compressed and a portion of that material is recycled, as Stream 113, and blended with the feed. The other portion, 114, is sent to Fuel gas.

These process flow diagrams are provided herein, as illustrations of the general process. Certain derivations are known to those skilled-in-the-art, such as further integration with conventional FCC light-ends recovery equipment, various heat integration options and product stabilization schemes.

EXAMPLES

An example of a catalyst useful in conjunction with the illustrated process, is provided in Example 1. Process performance of this catalyst, under low operating pressure conditions, is provided by Examples 2, 3, 4 and 5.

Example 1

200 grams of kaolin, previously calcined in air for 3 hours at 1100 C, was ground through a 60 um screen and combined with 200 grams of the molecular sieve ZSM5 possessing a Si/Al ratio of 38.2 ZSM-5, 30 grams of sesbania powder, 120 grams silicon sol gel, 30 grams sodium silicate, and 960 grams distilled water. The combined material was mixed in a high shear twin sigma blade mixer to form a paste of a suitable consistency to extrude through a short L/D multiple 3 mm cylinders die plate extruder. The resulting extrudate was calcined in air at 843 C for 3 hours. After calcination, the sodium cations are exchanged and the extrudate is calcined in air resulting in a finished catalyst.

Example 2

10 grams of 16 mesh particle size catalyst from Example 1 was loaded into a 0.500 inch diameter 316 SS reactor tube, equipped with a thermocouple, located in the middle of the catalyst bed. The reactor tube was then placed in an electric tube furnace. The reactor tube was heated to 300° C. under a constant flow of research grade nitrogen, while maintaining a back pressure of 50 psig.

Once the internal catalyst bed temperature stabilized at 300° C., 5 grams of liquid water was injected into the nitrogen stream at the rate of 0.25 grams/min via a feed pre-heater section. The liquid water was completely vaporized prior to contacting the hot catalyst bed. After steam treating the catalyst, the nitrogen feed was discontinued and 3.0 weight hour space velocity of a 3.0% Hydrogen, 12% Methane, 6.5% ethane, 6.0% ethylene, 72.5% nitrogen (by volume) was introduced to the reactor, while maintaining a backpressure of 50 psig. The catalyst bed temperature of 300° C. was maintained for 24 hours under the constant hydrocarbon feed; after which, it was increased to 315° C. at a rate of 1° C./minute. The entire product stream was analyzed by an Agilent 7890B gas chromatograph. The 12 hour average catalyst performance, from a time on stream of 128-140 hours, is provided in the table below.

| Catalyst Bed Temperature | WHSV | Ethylene Conversion | Ethylene Yield to Methane | Ethylene Yield to Ethane | Ethylene Yield to C3 hydrocarbon | Ethylene Yield to C4 hydrocarbon | Ethylene Yield to C5+ hydrocarbon |
|---|---|---|---|---|---|---|---|
| 315° C. | 3.0 | 92.5% | 3.6% | 4.6% | 5.3% | 14.5% | 72% |

The C5+ Product Composition was measured, on a mass percentage. This GC analysis was as follows:

| C5 isomers | C6 isomers | C7 isomers | Aromatics | C10 isomers | C12 isomers |
|---|---|---|---|---|---|
| 32% | 24% | 3.5% | 31.5% | 4.5% | 4.5% |

Example 3

The reactor start-up procedure of Example #2 was repeated for Example #1 Catalyst. After steaming the catalyst, the reactor temperature was maintained at 300° C. The nitrogen feed was discontinued and 2.6 WHSV of a 15 mole % ethylene in nitrogen feed was introduced at a back pressure of 50 psig. These conditions were held constant for 100 hours. The table below is the 10 hour average catalyst performance from a time on stream of 100-110 hours.

| Catalyst Bed Temperature | WHSV | Ethylene Conversion | Ethylene Yield to Methane | Ethylene Yield to Ethane | Ethylene Yield to C3 hydrocarbon | Ethylene Yield to C4 hydrocarbon | Ethylene Yield to C5+ hydrocarbon |
|---|---|---|---|---|---|---|---|
| 300° C. | 2.6 | 98.6% | 0.0% | 1.4% | 4.3% | 12.1% | 82.2% |

The C5+ Product Composition on a mass percentage basis was as follows:

| C5 isomers | C6 isomers | C7 isomers | Aromatics | C10 isomers | C12 isomers |
|---|---|---|---|---|---|
| 15.8% | 15.4% | 0.9% | 60.5% | 7.4% | 0.0% |

Example 4

The reactor start-up procedure of Example #2 was repeated for Example #1 Catalyst. After steaming the catalyst, the reactor temperature was increased to 325° C. at a rate of 1° C./minute. Once the reactor temperature stabilized, the nitrogen feed was discontinued and 1.0 WHSV of a 7.0% Hydrogen, 30% Methane, 17% ethane, 15% ethylene, 31% nitrogen (by volume) was introduced to the reactor while maintaining a backpressure of 45 psig. After 150 hours at the previously stated conditions, $H_2S$ was introduced in the feed at a rate of 200 ppm/hour. After 4 hours, the $H_2S$ was removed from the feed. The table below lists the 12 hour average catalyst performance pre and post $H_2S$ addition in the feed.

| | Ethylene Conversion | Ethylene Yield to Methane | Ethylene Yield to Ethane | Ethylene Yield to C3s | Ethylene Yield to C4s | Ethylene Yield to C5+ |
|---|---|---|---|---|---|---|
| Pre $H_2S$ Addition | 98.7% | 8.4% | 10.9% | 4.1% | 16.5% | 60.3% |
| Post $H_2S$ Addition | 98.6% | 6.7% | 8.2% | 4.2% | 16.5% | 64.4% |

As illustrated in Examples 2-4, the process yields for ethylene conversion into C4+ materials are sufficiently high (>80%) at the low operating pressures of choice. For feeds containing hydrogen (Example 2), a yield of greater than 86% C4+ was obtained. For feeds containing no hydrogen (Example 3), a yield of over 94% C4+ was obtained.

The difference in performance between Example 2 & 3, was identified to be caused by the hydrotreatment activity of the metals associated with the catalyst. The preferred catalyst metals composition, used to maintain catalyst life, was found to allow for some hydrotreating of ethylene to ethane, which lowered the potential C4+ yield for hydrogen containing streams.

Initially, Example 4 was made to determine how much catalyst activity would drop, given an upstream unit upset. For FCC Off-gas operations, Hydrogen sulphide is generally removed down to low levels (typically <10 ppm) so that it may be particularly used as low sulphur fuel gas. Example 4 was made to determine how much activity loss might be associated, should a unit upset occur in an FCC amine treater, causing high hydrogen sulphide to enter the process.

What was surprisingly discovered, rather than direct activity loss, during the Example 4 testing on the catalyst, was that short periods of sulphur additions were useful in improving the catalyst selectivity performance, by selectively reducing the hydrotreating activity and subsequently increasing the C4+ yields. This was surprising in that it occurred without a significant loss in the catalyst's dehydroaromatization activity.

At some point of high sulphur loading, it is rather expected that additional prolonged loading may cause the dehydroaromatization activity to decrease, and regeneration to be necessary in a short period of time. What example 4 illustrates is the potential use of sulphur additives to dampen possible hydrotreating activity, while maintaining dehydroaromatization activity at an acceptable level, when hydrogen is present in a dilute ethylene feed.

Example 5

The reactor start-up procedure of Example #2 was repeated for a y zeolite modified Example #1 Catalyst. The modification of the catalyst was achieved by adding 3% wt y zeolite to the ZSM5 powder prior to the mixing and extrusion step. After steaming the catalyst, the reactor temperature was increased to 345° C. at a rate of 1° C./minute. Once the reactor temperature stabilized, the nitrogen feed was discontinued and 1.0 WHSV of a 20% Hydrogen, 30% Methane, 17% ethane, 15% ethylene, 18% nitrogen (by volume) was introduced to the reactor while maintaining a backpressure of 30 psig. The table below list the 24 hour average catalyst performance for the y zeolite modified Example #1 catalyst and the ZSM 5 standard control Experimental #1 catalyst.

| Example # 1 Catalyst Zeolite Formula | Ethylene Conversion | Ethylene Yield to Methane | Ethylene Yield to Ethane | Ethylene Yield to C3s | Ethylene Yield to C4s | Ethylene Yield to C5+ | Grams C5+/liter catalyst * hr |
|---|---|---|---|---|---|---|---|
| ZSM5 | 98.1% | 11.2% | 13.2% | 8.8% | 27.5% | 39.8% | 46.6 |
| ZSM5 + 3% Y | 100% | 9..% | 11.3% | 7.9% | 27.9% | 43.8% | 52.3 |

Under high hydrogen feed content, the addition of y zeolite improves the C5+ product yield by reducing the hydro-treating activity. Y zeolite also improves the catalyst productivity by increasing the single pass ethylene conversion. A 12% C5+ productivity increase (on a mass basis) was achieved with a 3 wt % addition of y zeolite to the experimental Example #1 catalyst formulation.

LITERATURE REFERENCES

Chen et al., "*M-forming Process*", Ind. Eng. Chem. Res., Vol. 26, 1986, pp. 706-711.

Choudhary, V. et al., "*Aromatization of dilute ethylene over Ga-modified ZSM-5 type zeolite catalysts", Microporous and Mesoporous Materials*, Vol. 47, 2001, pp. 253-267.

Each and every reference discussed in the present document is herein incorporated by reference in its entirety.

What is claimed is:

1. An exothermic process of converting ethylene in a hydrocarbon gas feed, said process comprising:

a. contacting a hydrocarbon gas feed or a portion thereof comprising ethylene and propylene diluted with a dilution feed comprising hydrocarbons substantially free of olefins with a nitrogen-adsorbing guard bed;

b. introducing the hydrocarbon gas feed into a reactor comprising at least one heterogeneous dehydroaromatization catalyst comprising (i) ZSM-5;

(ii) amorphous silica, alumina, or a combination thereof;

(iii) Zn and/or Cu; and (iv) at least one exchanged metal of Group IA or IIA or lanthanide series; and c. converting ethylene and propylene in the hydrocarbon gas feed to a naphtha boiling-range product comprising at least one aromatic compound.

2. The process of claim 1, wherein the reactor further comprises at least two beds of catalyst, wherein each bed has an independent hydrocarbon gas feed point.

3. The process of claim 2, wherein said reactor further comprises a system for controlling the temperature of the hydrocarbon gas feed, wherein said system is located on at least one of the at least 2 feed points.

4. The process of claim 1, further comprising using at least one cross-exchanger to transfer heat from an effluent of the reactor or using at least one cross-exchanger to add heat to the hydrocarbon gas feed.

5. The process of claim 4, wherein the liquid naphtha boiling-range product is collected downstream of the cross-exchanger.

6. The process of claim 5, wherein said liquid naphtha boiling-range product is collected in a vapour/liquid separation drum, absorption tower or a distillation column, or any combination thereof.

7. The process of claim 1, wherein said nitrogen-adsorbing guard bed removes nitrogen compounds chosen from ammonia, nitriles, amines, and combinations thereof.

8. The process of claim 1, wherein the hydrocarbon gas feed or portion thereof comprises a refinery fluidized catalytic cracker gas (FCC Gas), a refinery deep catalytic cracker gas (DCC Gas), a refinery coker gas, equivalents or combinations thereof.

9. The process of claim 1, wherein the hydrocarbon gas feed further comprises trace quantities of water and trace quantities of hydrogen sulphide, mercaptans, carbon monoxide and/or carbon dioxide.

10. The process of claim 1, wherein said heterogenous dehydroaromatization catalyst comprises between about 20% and about 85% ZSM-5 by weight.

11. The process of claim 1, wherein the naphtha boiling-range product is a liquid.

12. The process of claim 1, wherein the hydrocarbon gas feed contains hydrogen.

13. The process of claim 1, wherein a temperature of the reactor is between about 200° C. and about 500° C.

14. The process of claim 1, wherein the heterogenous dehydroaromatization catalyst comprises a second three-dimensional-framework, crystalline, silica/alumina species in an amount less than about 35% weight.

15. The process of claim 14, wherein the second three-dimensional-framework, crystalline, silica/alumina species is Zeolite Y or Beta zeolite.

16. The process of claim 1, wherein a feed ratio of the hydrocarbon feed to the dilution feed is controlled.

17. The process of claim 16, whereby wherein the feed ratio is controlled to maintain an ethylene content in the feed of less than 20% by weight to the reactor.

18. The process of claim 16, wherein the dilution ratio changes for a single reactor over time.

19. The process of claim 16, wherein the dilution ratios of any two reactors processing the feed are independently controlled.

20. The process of claim 1, wherein the dilution feed comprises a methane rich gas or a process gas recycle.

* * * * *